US006925948B2

(12) United States Patent
Nakajima

(10) Patent No.: US 6,925,948 B2
(45) Date of Patent: Aug. 9, 2005

(54) CONDUIT-SUPPORTING STRUCTURE FOR A SMALL WATERCRAFT

(75) Inventor: Jun Nakajima, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/667,156

(22) Filed: Sep. 19, 2003

(65) Prior Publication Data

US 2004/0099194 A1 May 27, 2004

(30) Foreign Application Priority Data

Sep. 27, 2002 (JP) ..... 2002-284216

(51) Int. Cl.[7] ..... B63B 5/24
(52) U.S. Cl. ..... 114/55.5; 114/357
(58) Field of Search ..... 114/357, 55.5, 114/55.1

(56) References Cited

U.S. PATENT DOCUMENTS 5,240,443 A * 8/1993 Futaki ..... 440/38
6,155,896 A * 12/2000 Suzuki ..... 440/89 R
6,471,557 B1 * 10/2002 Hattori ..... 440/88 R

* cited by examiner

*Primary Examiner*—Jesus D. Sotelo
(74) *Attorney, Agent, or Firm*—Carrier, Blackman & Associates, P.C.; William D. Blackman; Joseph P. Carrier

(57) ABSTRACT

A conduit-supporting structure for a small watercraft allows the number of conduit guide components to be reduced, and the required number of processes in piping and wiring to be reduced during assembly. A vessel body includes a hull 14, constituting the lower portion thereof, and a deck for covering on top of the hull. A floatation insert block F1 is disposed between the hull 14 and the deck, and the block F1 is made with a supporting groove F1*a* formed therein, for guiding conduit such as a pipe and/or a cable. The conduit is guided along the supporting groove F1*a,* and is supported in the supporting groove F1*a* by being pushed therein, taking an advantage of the resiliency of the floatation insert block F1.

20 Claims, 6 Drawing Sheets

CONDUIT-SUPPORTING STRUCTURE FOR A SMALL WATERCRAFT

CROSS-REFERENCE TO RELATED APPLICATIONS

The present application claims priority under 35 U.S.C. 119, based on Japanese patent application No. 2002-284216, filed Sep. 27, 2002.

BACKGROUND OF THE INVENTION

1. Field of the Invention

The present invention relates to a conduit-supporting structure for supporting a conduit such as a pipe, wire or cable within a small watercraft. More importantly, the present invention relates to a conduit-supporting structure for a small watercraft that is incorporated into a flotation device, reduces the amount of related support structures and the number of wiring and piping procedures that are necessary during manufacturing of the vessel.

2. Description of the Background Art

A personal watercraft is known as a small vessel that is constructed and arranged to glide on the surface of a sea or lake. Many jet skis and other different types of personal watercraft are known and are commercially available.

One example of a small watercraft including a vessel body having a hull constituting the lower portion of the vessel body and a deck for covering on top thereof, and defining a floating space between the hull and the deck, is known and described in Japanese Patent Application JP-A-11-157482.

A small watercraft employing a cooling system, in which water outside the watercraft is fed through a jet pump and routed through a heat-generating object to be cooled, such as an engine or the like, and wherein the cooling system effectively cools the same and then heat is discharged outside the watercraft is also known, and is described in Japanese Patent Application JP-A-2001-98942.

Although the known devices have some utility for their intended purposes, a need still exists in the art for an improved conduit-supporting structure for a small watercraft. In particular, there is a need for an improved conduit-supporting structure which simplifies the process of assembling the vessel.

SUMMARY OF THE INVENTION

The present invention provides a conduit-supporting structure for supporting a conduit, such as a pipe, wire or cable inside of a small watercraft. In the small watercraft in the background art described above, a pipe for its cooling system, or a cable for electrical equipment has been supported on a inner wall of the watercraft, with a specific supporting fixture or the like.

Consequently, the number of components required for the watercraft is increased, and the number of processes in piping or wiring during assembly of the watercraft is also increased or made more complicated.

Accordingly, the present invention provides a conduit-supporting structure for a small watercraft in which the problems described above can be minimized or overcome, and thus the number of required components can be reduced, and the number of processes in piping or wiring during watercraft assembly may be reduced or simplified.

In order to achieve the object described above, a conduit-supporting structure for a small watercraft is integrally formed into a floatation insert block, which fits inside the vessel body. The vessel body includes a hull, which forms the lower portion of the vessel body, and a deck for covering on top of the hull. At least one floatation insert block is disposed between the hull and the deck, and the floatation insert block is made with a supporting groove formed therein for guiding the conduit.

The conduit-supporting structure for a small vessel body according to a first embodiment of the invention fits in the vessel body between the hull and the deck. The support structure hereof includes at least one floatation insert block disposed between the hull and the deck. The floatation insert block is made with a supporting groove formed therein for guiding a conduit, such as a pipe, wire or cable. Therefore, according to the described conduit-supporting structure for a small watercraft, the conduit may be guided and supported by the supporting groove on the floatation insert block.

Therefore, the specific supporting fixture or the like which has previously been used for supporting the pipe or the cable is not necessary, and thus the number of components may be reduced and the number of processes in piping or wiring may be reduced.

For a more complete understanding of the present invention, the reader is referred to the following detailed description section, which should be read in conjunction with the accompanying drawings. Throughout the following detailed description and in the drawings, like numbers refer to like parts.

BRIEF DESCRIPTION OF THE DRAWINGS

FIG. 6(*b*) is a front view of the floatation insert block, and FIG. 6(*c*) is a cross-sectional view of the floatation insert block, taken along the line c-c in FIG. 6(*b*).

DETAILED DESCRIPTION OF THE INVENTION

Figure 1:
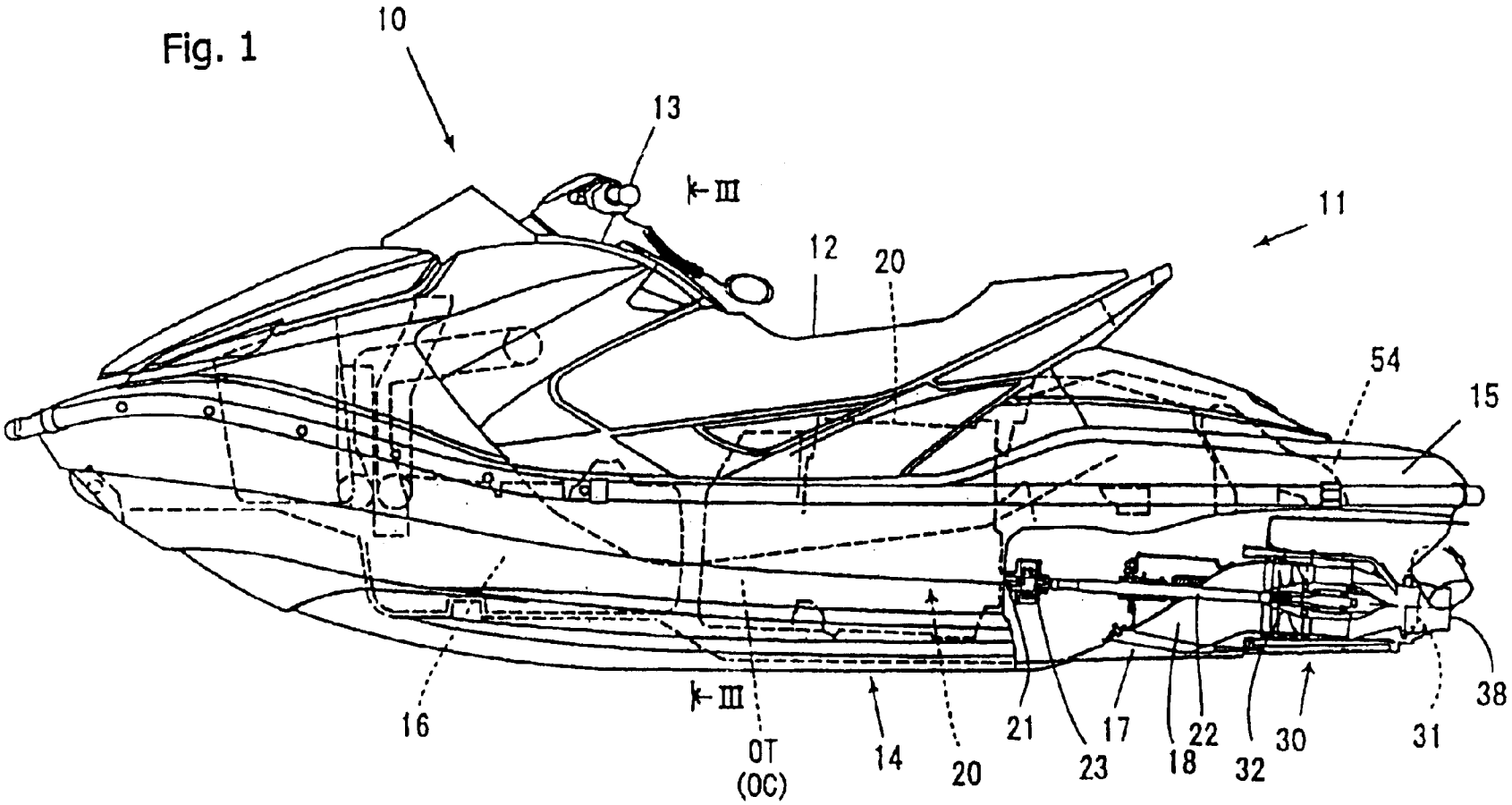
FIG. 1 is a side view, partially cut away, of a small watercraft using a selected illustrative embodiment of a conduit-supporting structure for a small watercraft according to the present invention.

Referring now to the drawings, a selected illustrative embodiment of the present invention will be described. It will be understood that the invention is not limited to the depicted embodiment, but can be made in different shapes and dimensions to fit the shape of any particular watercraft.

As shown in the drawings (mainly in FIG. 1), a small watercraft 10 is a saddle riding type small watercraft, in which an occupant is able to sit on a seat 12 of a vessel body 11 and to operate the watercraft while gripping a steering handle 13 with a throttle lever.

The vessel body 11 is a floating structure, having a vessel body 11 formed by joining a hull 14 and a deck 15, and defining an interior space 16 inside the vessel body.

Figure 3:
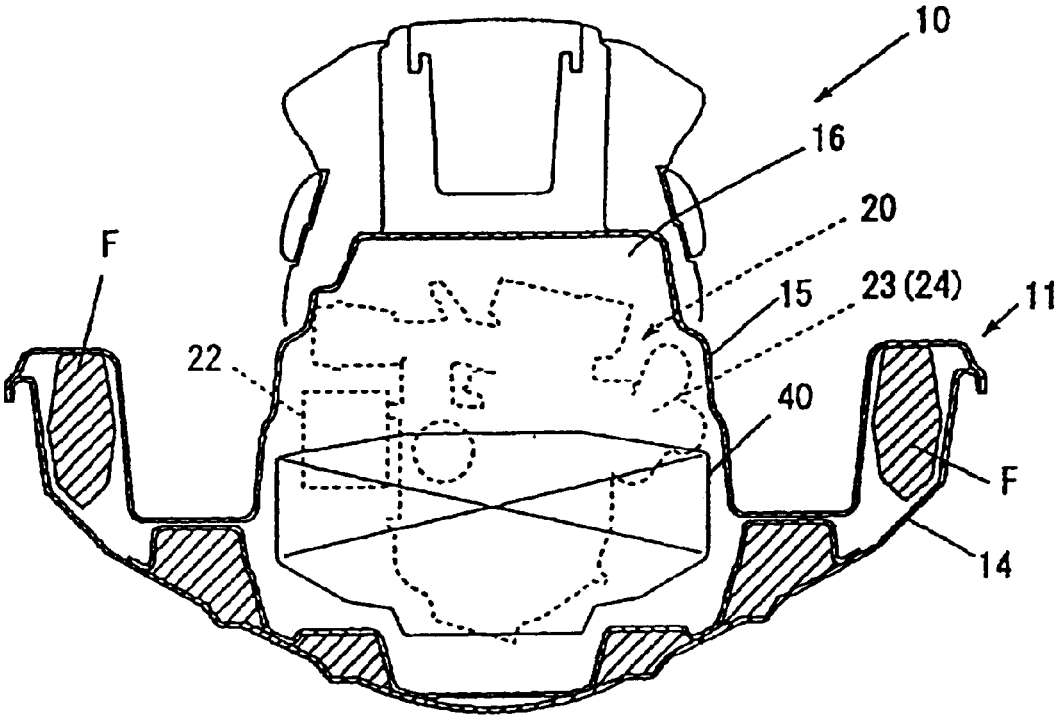
FIG. 3 is a partly enlarged cross-sectional view, taken along the line III—III in FIG. 1.

As shown in FIG. 3, a plurality of floatation insert bodies F (See FIG. 3) are disposed in the interior space 16 between the hull 14 and the deck 15, along substantially the entire periphery of the vessel body 11. The floatation insert bodies F are preferred to be formed from a resilient plastic material, such as for example, synthetic plastic or resin foam. The material of the floatation insert bodies F should be a buoyant material, which floats in water.

An engine 20 is mounted on the hull 14 in the interior space 16, and a water jet propeller (hereinafter referred to also as jet pump) 30, as propulsion means driven by the engine 20, is disposed at the rear of the hull 14.

The jet pump 30 includes an impeller 32 disposed in a channel 18 extending from a water intake 17 opening toward the bottom through a jet flow port 31 opening toward the rear end of the vessel body to a deflector 38, and a shaft (drive shaft) 22 for driving the impeller 32 is connected to an output shaft 21 of the engine 20 via a coupler 23. Therefore, when the impeller 32 is rotated by the engine 20 via the coupler 23 and the shaft 22, water taken from the water intake 17 is injected from the jet flow port 31 through the deflector 38, whereby the vessel body 11 is propelled. The number of rotations of the engine 20, that is, a propelling power generated by the jet pump 30, is controlled by rotating a throttle lever 13*a* (See FIG. 2) of the operating handle 13. The deflector 38 is linked to the operating handle 13 via an operating wire, not shown, and rotated by operating the handle 13, whereby the direction of travel of the vessel body 11 can be changed.

Figure 4:
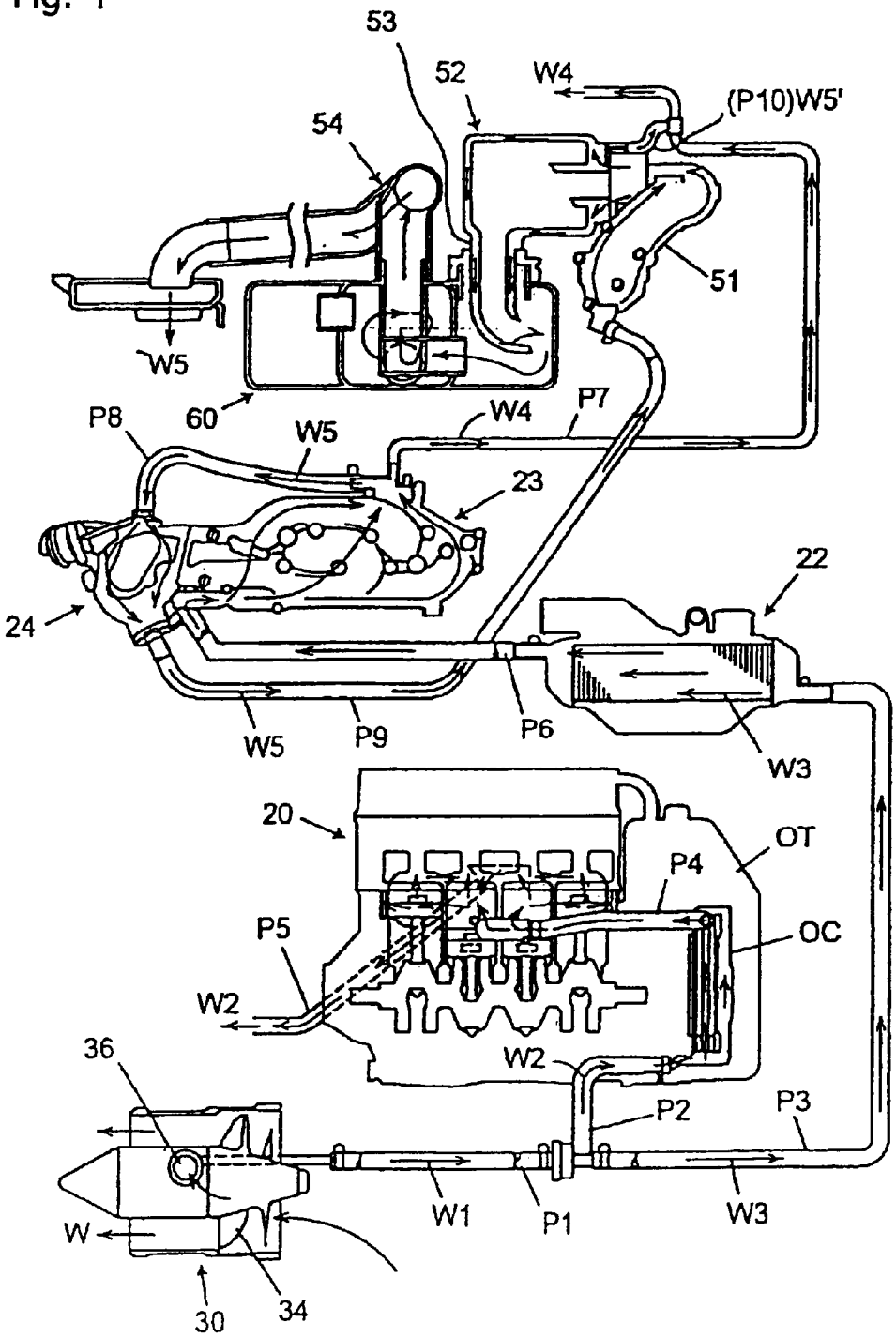
FIG. 4 is a schematic diagram showing a cooling system and route of the coolant for an engine which is a component of the watercraft of FIG. 1.

FIG. 4 is a drawing showing the cooling system for a small watercraft as described above, and is a drawing showing the route of the coolant in this system.

As shown in the same figure, a coolant intake port 36 is provided on the jet pump 30 downstream from the impeller 32, so that part W1 of jet water flow W generated by the impeller 32 is siphoned off by intake port 36 and used as coolant W1. The coolant W1 is supplied to a water jacket of the cooing object (engine 20, intercooler 22, and so on) through a coolant pipe P1-connected to the intake port 36.

The coolant W1 from the coolant pipe P1 connected to the intake port 36 is branched into pipes P2 and P3.

The coolant W2 in a first branch pipe P2 is fed to, and cools the oil cooler OC in the oil tank OT (See FIG. 1, FIG. 2) provided on the front portion of the engine 20. After leaving the oil cooler OC, the coolant water is fed through pipe P4 to cool the cylinder block and a cylinder head of the engine 20, and then is drained to a water flow (outside the watercraft) generated by the jet pump 30 via a pipe P5.

Figure 2:
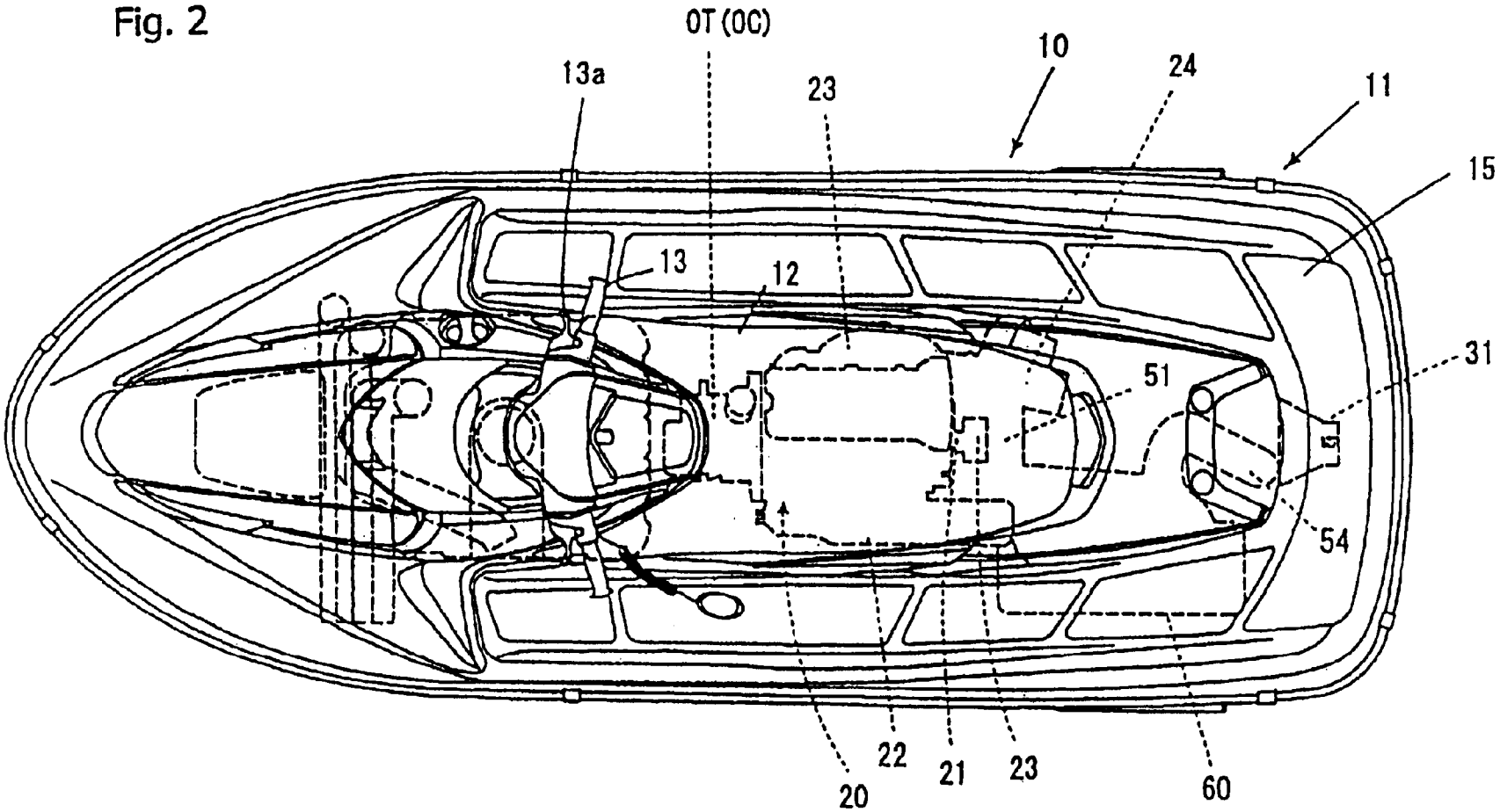
FIG. 2 is a top plan view of the watercraft of FIG. 1.

The coolant W3 in the other branch pipe P3 is fed to and cools the intercooler 22 (See FIG. 2, FIG. 3), and then fed through a pipe P6 to cool the exhaust manifold 23 (See FIG. 2, FIG. 3).

After it has cooled the exhaust manifold 23, the coolant W3 is then further branched into pipes P7 and P8 above the exhaust manifold 23.

One sub-branch pipe P7 is connected to a pilot water nozzle (not shown) at the extremity thereof, and a coolant W4 flown to the pipe P7 is drained from the pilot water nozzle to the outside the watercraft.

The coolant W5 in the other sub-branch pipe P8 is fed to and cools a turbocharger 24 (See FIG. 2, FIG. 3), and is then fed through a pipe P9 to cool a first exhaust pipe 51, a back-flow preventing chamber 52, and a second exhaust pipe 53. After it has cooled the second exhaust pipe 53, the coolant water W5 is then injected from the lower end of the second exhaust pipe 53 into the water muffler 60. In the water muffler 60, the coolant water W5 is joined with exhaust gas in the water muffler 60, and is then discharged through an exhaust/drain pipe 54 (See FIG. 1, FIG. 2) and thence into a water flow (outside the watercraft) generated by the jet pump 30.

Part W5' of the coolant W5 which has cooled the first exhaust pipe 51 is flown through a pipe P10 and joined into the aforementioned pipe P7, and then drained from the watercraft through the pilot water nozzle with the coolant W4.

Figure 5:
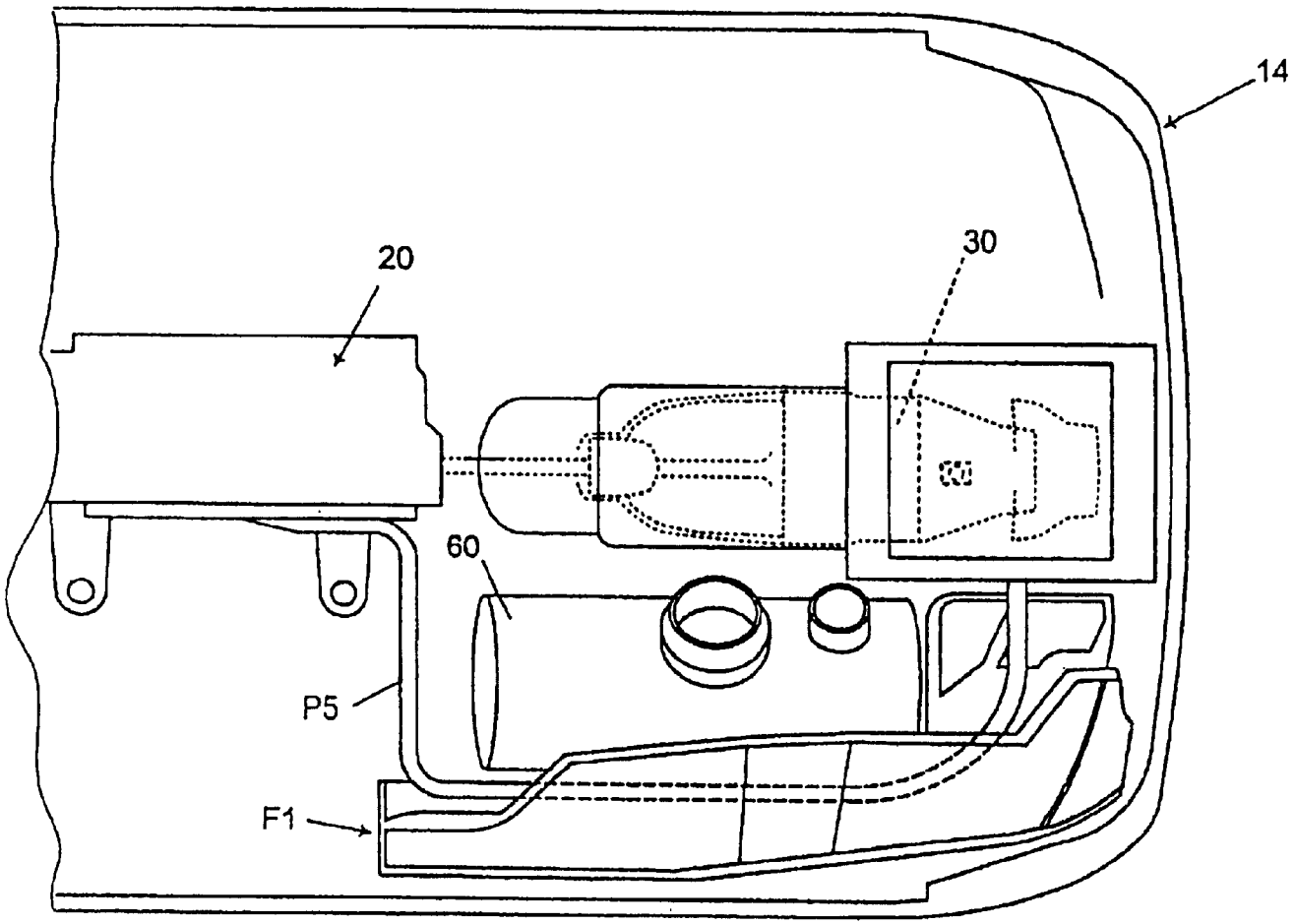
FIG. 5 is a top plan view, partially cut away showing a rear portion of the vessel body of the watercraft of FIGS. 1–2, with a deck 15 removed from the vessel body.

FIG. 5 is a general plan view showing a rear portion of the vessel body with the deck 15 removed.

In FIG. 5, F1 designates an illustrative floatation insert block F, which is disposed at a rear corner of the vessel body 11.

As described above, P5 represents a pipe for routing coolant water, which has cooled the engine 20, into a water flow generated by the jet pump 30. In this embodiment, and as will be further described herein, the coolant pipe P5 fits into a groove in, and is supported by the aforementioned floatation insert block F1.

Figure 6A:
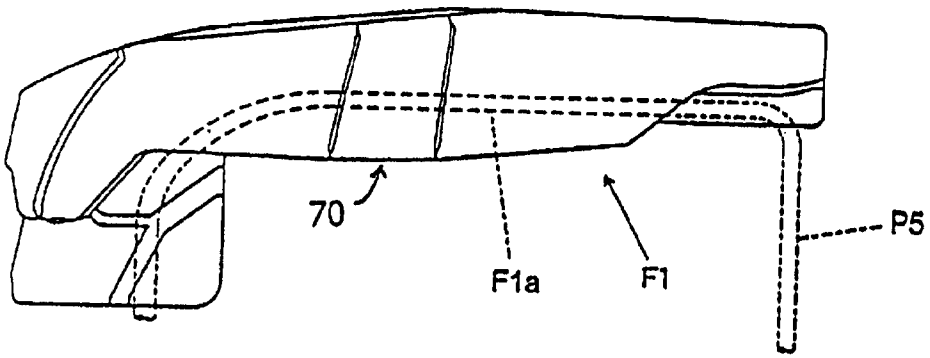
FIG. 6(*a*) is a bottom plan view of a floatation insert block according to an illustrative embodiment of the invention.
Figure 6B:
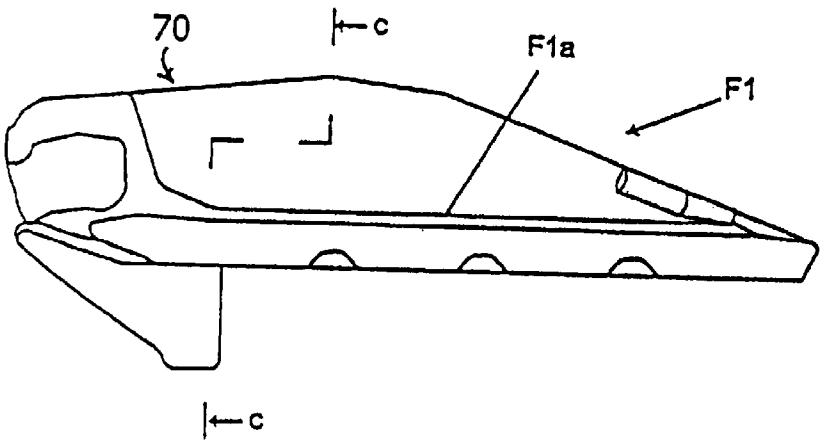
Figure 6C:
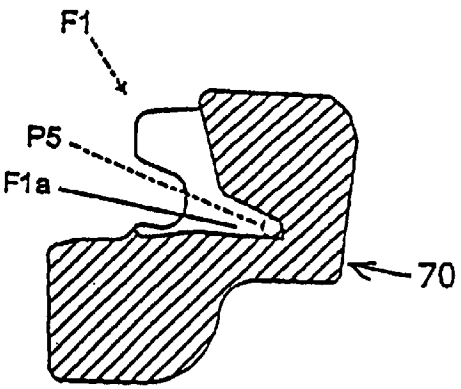

Referring now to FIGS. 6(*a*) through 6(*c*), the floatation insert block F1 includes a main block body 70 which is constructed and arranged to fit nestingly in a selected portion of the interior space inside the vessel body. The main block body 70 is made with a supporting groove F1*a* formed therein, for supportively receiving and guiding the aforementioned pipe P5. As shown in FIGS. 5 and 6(*a*) through 6(*c*) of the drawings, the groove F1*a* is open on one side thereof to permit insertion of the conduit P5 thereinto, or removal of the conduit therefrom. As seen, best in FIG. 6(*c*), a portion of the groove F1*a* has a tapered cross-section which is widest near the open portion thereof, and narrowest at the innermost portion thereof. This shape facilitates insertion of the conduit into the insert block F1, and removal of the conduit therefrom.

Further in this embodiment, the floatation insert block F may be made with one or more additional grooves formed therein, for guiding other conduits, which may include pipes, wires and/or cables.

In this manner, provision of the supporting groove(s) for guiding conduits such as the pipe and/or the cable through the floatation insert block F enables the conduit to be guided along the supporting groove. The conduit may also be held by the insert block F at the supporting groove by being pushed therein, taking advantage of the resiliency of the floatation insert block F.

In the conduit-supporting structure for a small watercraft as described above, the vessel body 11 is constructed by the hull 14, constituting the lower portion thereof, and the deck 15 for covering on top of the hull. The floatation insert block F is disposed between the hull 14 and the deck 15, and the floatation insert block F is made with the supporting groove formed therein, for guiding the pipe and/or the cable. Therefore, according to the conduit-supporting structure for a small watercraft, the pipe and/or the cable can be guided and supported by the supporting groove on the floatation insert block.

Therefore, the specific supporting fixture or the like, which has previously been needed for supporting the pipe or the cable is not necessary, which reduces the number of components required, and simplifies the processes of piping and wiring during assembly of the vessel.

Although the present invention has been described herein with respect to a selected embodiment, the foregoing description is intended to be illustrative, and not restrictive. Those skilled in the art will realize that many modifications of the preferred embodiment could be made which would be operable. All such modifications, which are within the scope of the appended claims, are intended to be within the scope and spirit of the present invention.

What is claimed is:

1. A conduit-supporting structure for a small vessel body comprising a hull and a deck for covering placement on top of the hull, with an interior space defined between the hull and the deck thereof;

said conduit-supporting structure comprising a floatation insert block for placement inside the vessel body interior space between the hull and the deck;

wherein said floatation insert block is made with a support groove formed therein for supportively receiving at least one conduit, said support groove being open on one side thereof to permit insertion or removal of said conduit, wherein said block is formed from a resiliently flexible material, and is adapted to resiliently retain a conduit placed in the support groove thereof.

2. The conduit-supporting structure of claim 1, wherein the floatation inset block is formed from a resilient plastic foam material.

3. The conduit-supporting structure of claim 1, wherein the floatation insert block is formed from a buoyant material.

4. The conduit-supporting structure of claim 1, wherein the floatation insert block is constructed and aligned to fit the contours of the interior space within the small vessel body.

5. The conduit-supporting structure of claim 1, wherein the support groove is adapted to supportively receive a pipe therein.

6. The conduit-supporting structure of claim 1, wherein the support groove is adapted to supportively receive a wire therein.

7. The conduit-supporting structure of claim 1, wherein the support groove is adapted to supportively receive a cable therein.

8. The conduit-supporting structure of claim 1, wherein said floatation insert block is constructed and arranged to fit nestingly in a selected part of said interior space of said small vessel body.

9. A floatation insert block for placement in an interior space of a small watercraft between a hull and a deck of said watercraft, said floatation insert block comprising a main block body formed from a flexibly resilient plastic foam material, said main block body having a support groove formed therein for supportively receiving at least one conduit, said support groove being open on one side thereof to permit insertion or removal of said conduit, wherein said block is adapted to resiliently retain a conduit placed in the support grove thereof.

10. The floatation insert block of claim 9, wherein the floatation insert block is constructed and arranged to fit nestingly in a selected part of said interior space of said watercraft.

11. The floatation insert block of claim 9, wherein the floatation insert block is formed from a buoyant material.

12. The floatation insert block of claim 9, wherein the support group is adapted to supportively receive a pipe therein.

13. The floatation insert block of claim 9, wherein the support groove is adapted to supportively receive a wire therein.

14. The floatation insert block of claim 9, wherein the support groove is adapted to supportively receive a cable therein.

15. A small watercraft comprising a hull and a deck for covering placement on top of the hull, with an interior space defined between the hull and the deck thereof, said watercraft having a plurality of the floatation insert blocks of claim 9 installed in said interior space.

16. The watercraft of claim 15, wherein at least some of said floatation insert blocks are spaced away from an inner hull wall of said watercraft.

17. The watercraft of claim 15, wherein the floatation insert blocks are formed from a buoyant material.

18. A conduit-supporting structure for a small vessel body, said conduit-supporting structure comprising a floatation insert block for placement inside an interior space of the vessel body;

wherein said floatation insert block is made with a support groove formed therein for supportively receiving at least one conduit, said support groove being open on one side thereof to permit insertion or removal of said conduit, and wherein the support groove is formed in a portion of an exterior surface of the floatation insert block, wherein said block is formed from a resiliently flexible material, and is adapted to resiliently retain a conduit placed in the support groove thereof.

19. The insert block of claim 9, wherein the block is configured to be spaced away from an inner hull wall of said watercraft in an installed configuration thereof.

20. The insert block of claim 9, wherein a portion of said groove has a tapered cross-section which is wider near the open portion thereof, and narrower at the innermost portion thereof.

* * * * *

UNITED STATES PATENT AND TRADEMARK OFFICE

CERTIFICATE OF CORRECTION

PATENT NO. : 6,925,948 B2
APPLICATION NO. : 10/667156
DATED : August 9, 2005
INVENTOR(S) : Nakajima It is certified that error appears in the above-identified patent and that said Letters Patent is hereby corrected as shown below:

Column 1:
Line 54, change “on a inner wall” to --on an inner wall--.

Column 3:
Line 39, change “the cooing object” to --the cooling object--.
Line 61, change “the outside the watercraft” to --the outside of the watercraft--.

Column 4:
Line 21, after “and is supported by” insert a comma.
Line 32, after “from. As seen” delete the comma.
Line 33, change “cross-section” to --cross section--.

Column 5:
Line 23, change “floatation inset block” to --floatation insert block--.
Line 28, change “constructed and aligned” to --constructed and arranged--.

Column 6:
Line 2, change “support grove” to --support groove--.
Line 46, change “cross-section” to --cross section--.

Signed and Sealed this

Twenty-first Day of April, 2009

John Doll

JOHN DOLL
*Acting Director of the United States Patent and Trademark Office*